United States Patent [19]

Palethorpe et al.

[11] 3,932,577

[45] Jan. 13, 1976

[54] METHOD FOR MAKING VOID-FREE ACRYLIC FIBERS

[75] Inventors: George Palethorpe, Durham; Edwin W. Folk, Cary, both of N.C.

[73] Assignee: Monsanto Company, St. Louis, Mo.

[22] Filed: May 21, 1973

[21] Appl. No.: 362,632

[52] U.S. Cl. ..... 264/182; 264/211

[51] Int. Cl.[2] ..... D01F 6/18

[58] Field of Search..... 264/182, 211; 260/29.6 AQ

[56] References Cited

UNITED STATES PATENTS

| | | | |
|---|---|---|---|
| 2,752,318 | 6/1956 | DeWitt | 260/29.6 AQ |
| 2,858,288 | 10/1958 | Ehlers et al. | 260/29.6 AQ |
| 3,313,758 | 4/1967 | Apperson et al. | 260/29.6 AQ |
| 3,706,828 | 12/1972 | Tzentis | 264/177 F |

*Primary Examiner*—Jay H. Woo

*Attorney, Agent, or Firm*—Robert L. Broad, Jr.

[57] ABSTRACT

Method for making substantially void-free fibers having improved abrasion resistance wherein a spinning dope is formed by dissolving a dry acrylonitrile-containing polymer in a solvent/water mixture to form a spin dope which is wet spun at a temperature within the range of about 40°C to about 75°C. More specifically, the dope will contain from about 20 to about 28 weight percent of the polymer dissolved in a solvent containing about 1 to 8 weight percent water, based on the weight of the dope, with the solvent and water being mixed prior to contact with the polymer. The presence of water in the solvent brings about an improvement of the filamentary gel structure which results in fibers having enhanced durability and abrasion resistance.

4 Claims, No Drawings

METHOD FOR MAKING VOID-FREE ACRYLIC FIBERS

BACKGROUND OF THE INVENTION

This invention relates to a process for making acrylonitrile-containing fibers which have a substantially void-free structure and excellent fiber durability characteristics.

Polymers of acrylonitrile, such as polyacrylonitrile and copolymers of acrylonitrile, with minor proportions of ethylenically unsaturated copolymerizable compounds, such as vinyl acetate, styrene, vinylidene chloride, vinyl bromide, and the like are known to be excellent fiber-forming materials. Various polymers comprising acrylonitrile and other ethylenically unsaturated monomers can be spun into synthetic fibers having enhanced physical properties. When wet or dry spun the filaments so produced have excellent tensile properties, desirable elongation, and superior stability under a wide range of physical and chemical conditions.

The conventional technique for preparing filaments from acrylonitrile-containing polymers, which have been previously filtered and dried from an aqueous medium, involves the dissociation of these polymers in a suitable organic solvent such as dimethylformamide, dimethylacetamide, or dimethylsulfoxide and thereafter extruding the solution so prepared through an orifice into an aqueous medium which removes the solvent and coagulates the polymer in a continuous form. It is generally known that from the very beginning of filament formation in conventional wet spinning there is a very thin outer layer formed during coagulation which has a marked susceptibility to rupture, even upon careful withdrawal from a coagulating bath, with the result that numerous voids are often produced in the fiber. The presence of such voids has a direct bearing on the durability of the fiber, the durability decreasing as the voids increase. Certain techniques have been employed to improve the fiber characteristics, expecially durability properties, of acrylonitrile-containing polymers with varying degrees of success. Generally, such processing techniques involve incorporation of various monomers into the polymer structure and special treatment during processing of the filaments. This invention produces fibers having excellent abrasion resistance characteristics through the use of a straightforward and inexpensive process.

One of the objects of this invention is to provide a method for making acrylonitrile-containing fibers having improved durability.

Another object of this invention is to provide a method for making substantially void-free acrylonitrile-containing fibers.

Still another object of this invention is to provide a process for making an acrylonitrile-containing fiber having improved abrasion resistance.

Other objects and advantages of this invention will be apparent from the following description.

In accordance with this invention an acrylonitrile-containing filament having an essentially void-free structure is made by forming a spinning dope by dissolving (A) about 20 to 28 weight percent of a dry polymer containing about 35 to about 98 weight percent acrylonitrile and 65 to 2 weight percent of at least one other mono-olefinic monomer copolymerizable therewith in (B) a mixture of about 64 to 79 weight percent of a solvent for the polymer and about 1 to 8 weight percent water, based on the dope, and extruding the dope, at a temperature within the range of about 40° C to about 75° C, into a coagulant bath comprising an aqueous solution of from about 50 to about 65 weight percent of said solvent at a coagulation temperature of from about 30° C to 65° C. It is important that the solvent and the water be mixed prior to contact with the polymer.

Polymers of acrylonitrile are usually produced by aqueous dispersion processes. Generally, the polymers produced are readily filtered from the reaction medium and are usually washed prior to drying. As there are certain spinning problems associated with the presence of water in solutions or dopes of acrylonitrile polymer it has been generally considered advisable to remove essentially all water from the polymer. It is known that if water is directly added to a spinning dope comprising acrylonitrile and a conventional solvent, gelation may occur, making the dope very difficult to spin and producing filaments of poor quality.

It has been unexpectedly found that the abrasion resistance characteristics of acrylonitrile-containing fibers can be greatly enhanced by the introduction of from about 1 to about 8 percent water into conventional solvents for acrylonitrile polymers, prior to bringing the solvent and dry polymer together. Amounts below about 1 percent water do not show any of the advantages herein described, while amounts of water above about 8 percent often cause premature gelation and increased dope viscosity.

For example, Canadian patent 690,360 to Pease teaches that water in acrylonitrile polymers reduces solubility of the polymers and tends to cause gelation of the polymer. Pease overcomes the problem by washing the wet polymer with an aqueous solution containing from about 75 percent to 90 percent of a solvent for the polymer and then filtering the polymer to reduce its water content. About 25 percent to 65 percent of pure solvent is then added to the solvent-wet filter cake prior to spinning.

In accordance with this invention small amounts of water mixed with conventional solvents such as dimethylformamide, dimethylacetamide, and dimethylsulfoxide can be successfully employed for dissolving dry acrylonitrile-containing polymers for wet spinning. The presence of water in the solvent brings about an improvement of the filamentary gel structure during wet spinning which results in fibers of enhanced durability and abrasion resistance.

It will be appreciated that the present invention make possible the production of acrylonitrile polymer filaments that have optimum durability properties through the use of a convenient and inexpensive process which requires no equipment modifications. Also, filaments produced in accordance with this invention are eminently suitable for use in making durable carpets and various textile articles exhibiting excellent resistance to abrasion, without sacrifice of other essential filamentary properties.

Dry polymers of acrylonitrile and copolymers thereof are generally available in granular or pellet form. The moisture content of these dry polymers is usually below 1.0 weight percent, with the most common moisture content being below 0.5 percent. A spinning dope from these polymers can be readily formed in accordance with this invention by dissolving the polymer in a conventional solvent mixed with from 1 to 8 percent water, based on the weight of dope, and heating the polymer-aqueous-solvent mixture to about 40° C to 75° C, with stirring, until the polymer is completely dissolved. It is important that the temperature not be excessive in order to avoid any undesirable coloration of the polymer. In most wet processing it is preferred to prepare spinning dopes containing from about 20 to about 28 weight percent of an acrylonitrile-containing polymer. A most preferred spinning dope is one containing from about 23 to about 27 weight percent of said polymers.

The introduction of water into the solvent may be readily accomplished by metering water into the solvent and mixing thoroughly. The solvent containing the water may thereafter be mixed with the polymer to form the spinning dope. The mixing of the solvent and water prior to contact with the polymer appears to reduce the likelihood of gelation and gives superior control of the amount of water used.

By maintaining the specified concentration of water in the spinning dope prior to extrusion, followed by other conditions to be described hereinafter, the filaments formed will have markedly enhanced properties. It is believed that void formations are attributable to the interplay of diffusion forces at the surface of the fiber during spin bath coagulation wherein there is an inward diffusion of coagulating bath liquid into the filament and at the same moment an outward movement of solvent from the filament. This void formation may be substantially minimized by what is apparently a reduction in the differential of diffusion forces through employment of small amounts of water in the spinning dope.

The coagulating bath which is used contains a mixture of a solvent and a non-solvent, such as water, for the acrylonitrile polymer. The solvent used in the coagulating bath is preferably the same as the one used in preparing the polymer solution; however, such need not be the case. The solvent employed is preferably dimethylacetamide, dimethylformamide or dimethylsulfoxide.

The exchange of solvent from the gel structure occurs when the filaments are passed through a bath preferably of from about 40 to 65 weight percent solvent with the remaining percentage being water, while maintaining the bath temperature in the range of 30° C to 65° C, and preferably between 50° C and 60° C.

Since the dope viscosity of the acrylonitrile-containing polymer varies directly with its temperature, employment of a high spinning dope temperature has the result that low extrusion pressures are required. However, in order to spin an acrylonitrile polymer dope by the conventional wet spinning method, it is necessary to avoid elevated bath temperatures, since such temperatures substantially reduce the solvent extraction efficiency. Generally, a temperature for the dope in the range of between 40° C to 75° C is most desirable in accordance with this invention.

Following passage through the coagulating bath, the filaments are washed substantially free of solvent. This may be accomplished by spraying water on the filament travelling around driven rolls or passing the filaments through a cascade containing boiling water. Other washing methods can be employed. The washing can be carried out prior to applying any orientation stretch to the filament if desired.

It has been found that there is generally a lower amount of residual solvent present in filaments treated in accordance with this invention than in conventional procedures where there is no water in the spinning dope. Using identical compositions and procedures the dimethylacetamide content of conventional filaments generally is about 0.3 weight percent. In filaments made in accordance with this invention the residual solvent content has been found to be lowered even further to between about 0.20 weight percent to about 0.05 weight percent.

The polymeric materials which may be employed in the practice of the present invention are polyacrylonitrile, copolymers, including binary and ternary polymers containing at least 35 percent by weight of acrylonitrile in the polymer molecule, or a blend comprising polyacrylonitrile or copolymers comprising acrylonitrile with from 2 to 50 percent of another polymeric material, the blend having an overall polymerized acrylonitrile content of at least 35 percent by weight. Although the preferred polymers employed in the instant invention are those containing about 80 percent acrylonitrile, generally recognized as the fiber-forming acrylonitrile polymers, it will be understood that the invention is applicable to polymers containing between about 35 to about 97 weight percent acrylonitrile.

For example, the polymer may be a copolymer of from 80 to 98 weight percent acrylonitrile and from 2 to 20 weight percent of another monomer containing the >C = C< linkage and copolymerizable with acrylonitrile. Suitable mono-olefinic monomers include acrylic, alpha-chloroacrylic and methacrylic acids; the acrylates, such as methyl acrylate, ethyl acrylate, methylmethacrylate, ethylmethacrylate, butylmethacrylate, methoxymethyl methacrylate, beta-chloroethyl methacrylate, and the corresponding esters of acrylic and alpha-chloroacrylic acids; vinyl chloroide, vinyl fluoride, vinyl bromide, vinylidene chloride, 1-chloro-1 bromoethylene; methacrylonitrile; acrylamide and methacrylamide; alpha-chloroacrylamide, or monoalkyl substitution products thereof; methyl vinyl ketone; vinyl carboxylates, such as vinyl acetate, vinyl chloroacetate, vinyl propionate, and vinyl stearate; N-vinylimides, such as N-vinylphthalimide and N-vinylsuccinimide; methylene malonic esters; N-vinylcarbazole; vinyl furane; alkyl vinyl esters; styrene, vinyl naphthalene; vinyl-substituted tertiary heterocyclic amines, such as the vinylpyridines and alkyl-substituted vinylpyridines, for example, 2-vinylpyridine, 4-vinylpyridine, 2-methyl-5-vinylpyridine, etc.; 1-vinylimidazole and alkyl-substituted 1-vinylimidazoles, such as 2-, 4-, or 5-methyl-1-vinylimidazole and other >C = C< containing polymerizable materials.

The polymer may be a ternary interpolymer, for example, products obtained by the interpolymerization of acrylonitrile and two or more of any of the monomers, other than acrylonitrile, enumerated above. More specifically, and preferably, the ternary polymers comprise acrylonitrile, vinyl acetate, and vinyl bromide. The ternary polymers preferably contain from 80 to 97 percent of acrylonitrile, from 1 to 10 percent of vinyl acetate or styrene, and from 1 to 18 percent of another monomer, such as vinylidene chloride or vinyl bromide.

The polymer may also be a blend of polyacrylonitrile or of a binary interpolymer of from 80 to 99 percent acrylonitrile and from 1 to 20 percent of at least one other >C = C< containing substance with from 2 to 50 percent of the weight of the blend of a copolymer of from 10 to 70 percent of acrylonitrile and from 30 to 90 percent of at least one other >C = C< containing polymerizable monomer.

The polymer materials of this invention may readily have incorporated therein various acidic and basic monomers to increase their dyeability with various dyes; for example, sodium paramethacrylamidobenzenesulfonate, sodium styrenesulfonate, sodium methallylsulfonate, fumaric acid, itaconic acid, and various $\beta$-alkyl and $\alpha,\beta$-dialkyl allyloxybenzenesulfonic acids and sulfonate salts thereof, such as sodium paramethallyloxy benzenesulfonate; various tertiary amino alkyl ester monomers, such as dimethylaminoethyl methacrylate and various quaternary ammonium monomers, such as 2-methacryloyltrimethyl ammonium methylsulfate and various N-heterocyclic monomers, such as N-allylnicotinamide and the like. Generally, such monomers may be employed in amounts of from about 0.1 to about 10 percent, based on the polymer weight.

EXAMPLE 1

A spinning dope was prepared by dissolving a sufficient amount of a polymer in N,N-dimethylacetamide containing about 4 percent water to give a 25 percent solids dope, the polymer comprising 70 weight percent acrylonitrile (AN), 20 weight percent vinylidene chloride ($VCl_2$), 10 weight percent vinyl bromide (VBr), 1.5 weight percent styrene (S), and 1.5 weight percent itaconic acid (IA). The dope was heated to about 40° C while being mixed until a clear liquid resulted. The resulting dope was thereafter cooled to a temperature of about 30° C, filtered, and extruded at about 12 ml/min. through a spinnerette (100 holes/5 mil.) submerged in a coagulation bath composed of 55 parts dimethylacetamide and 45 parts water maintained at a temperature of about 40° C. The filaments so formed were withdrawn from the coagulation bath after a travel therein of about 18 inches and then directed over a first godet at 19.8 feet per minute and then through a boiling water bath toward and over a second godet at about 84.2 feet per minute. Thereafter, the filaments were dried by passing them over rotating drying rolls maintained at a temperature of about 125° C. The denier of the resulting fibers, elongation, and tenacity is as shown in Table I, Sample IB. Microscopic examination of randomly selected filaments obtained from the first godet show an essentially void-free structure. By way of comparison a control sample was prepared, Sample IA, this sample differing from Sample IB only in that no water was added to the solvent. Refer to Sample IA in the table.

EXAMPLE 2

A spinning dope composition, Sample IIB, was prepared identical to that with Sample IB of Example 1 with the exception that the spinning was done at 30° C. Fiber properties are shown in Table I, Sample IIB. Randomly selected fibers revealed under the microscope an essentially void-free structure.

Example 1 was repeated using a spin bath temperature of 30° C with no water in the solvent. The sample where water was used in the spinning dope had a substantially void-free structure while the sample prepared from the dope containing no water had a porous structure. Refer to Sample IIA in the table.

EXAMPLE 3

Fibers were prepared from a spinning dope having a composition of AN/$VCl_2$ (60/40) under the conditions of Example 1 with the exception that the dope was held at about 60° C for about 30 minutes prior to being extruded. The fiber properties are shown in Table I, Sample IIIB, and can be compared to fibers prepared in the same way but from dopes having no water added to the solvent (Sample IIIA, Table I). The resulting solvent content of Sample IIIA was 2.25 percent and the solvent content of Sample IIIB was 2.14 percent. Sample IIIB showed a void-free structure as compared with Sample IIIA.

EXAMPLE 4

A spinning dope was prepared having the same composition as Sample IB, Example 1, except that the solvent used was dimethylsulfoxide containing about 4 percent water. The dope was held at 60° C for about 30 minutes prior to being extruded, and the coagulation bath was made up of 55 weight percent dimethylsulfoxide and 45 weight percent water. The fiber properties are shown in Table I, Sample IVB, and can be compared to a fiber having no water added to the solvent and spun under identical conditions, Sample IVA. The resulting solvent content of Sample IVA was 0.42 percent and the solvent content of Sample IVB was 0.19 percent. Sample IVB had a void-free structure as compared with Sample IVA.

EXAMPLE 5

An aqueous solvent was prepared by mixing 14,500 grams of dimethylacetamide with 500 grams of water. About 5,000 grams of a copolymer of 93 weight percent acrylonitrile and 7 weight percent vinyl acetate was then slurried into the aqueous solvent with constant mixing. The aqueous solvent-polymer mixture was slowly heated to 70° C over a period of 30 minutes and held at that temperature for about 30 minutes to dissolve the polymer. The spinning dope was filtered and passed through a 2,220 hole spinnerette (0.003 inch hole diameter) and coagulated in a bath made up of 55 percent dimethylacetamide and 45 percent water at about 65° C. The spinning dope passed through the spinnerette at a rate of about 80 ml/min. The filaments produced were washed and then given a 5.5X draw in boiling water. The filaments were thereafter crimped, annealed by subjecting them to 30 psig steam, and cut to about 2 inch staple for fabric preparation.

By way of comparison, a control spinning dope was identically prepared containing a copolymer of 93 weight percent acrylonitrile and 7 weight percent vinyl acetate dissolved in a solvent containing no water. The dope was spun, crimped, annealed and cut into staple fiber.

The fiber properties of these two fibers are shown in Table I. The fibers spun having an aqueous solvent, Sample VB, show an essentially void-free structure when viewed under the microscope as compared with fibers produced from solvent having no added water, Sample VA.

A flat upholstery fabric was prepared from fibers of Sample VA and VB and subjected to a Martindale Wear Tester which employed standard wool fabric as an abradant. The fabric of Sample VB gave an average end point of $10.4 \times 10^4$ revolutions as compared to Sample VB, giving an average end point of $23 \times 10^3$ revolutions.

EXAMPLE 6

A spinning dope was prepared containing 25 percent solids concentration of a polymer made up of 87.9 weight percent acrylonitrile, 7.1 weight percent vinyl acetate and 5 weight percent vinyl bromide, dissolved in a mixture of 72.4 weight percent dimethylacetamide and 2.6 weight percent water. The spinning dope was filtered and passed through a 500 hole spinnerette (0.005 inch hole diameter) and coagulated in a dimethylacetamide-water bath (55/45) at 60° C. The filaments, Sample VIB, were subjected to a 6X stretch in boiling water, crimped, annealed at about 35 psig of steam and cut to about 4 inch staple for carpet preparation. Sample VIA, containing about 87.9 weight percent acrylonitrile, 7.1 weight percent vinyl acetate, and 5 weight percent vinyl bromide was dissolved in dimethylacetamide having no water added thereto. The dope was filtered and spun and the filaments produced were stretched, crimped, annealed as before. The fibers produced had a substantial number of voids throughout the fiber structure.

The fiber properties for Sample VIA and VIB are shown in Table I. A carpet was durability tested employing a Simstair tester. Sample VIA reached the end point after an average of $3.2 \times 10^3$ impacts, and the fabric woven from the Sample VIB fibers reached its end point after $17.6 \times 10^3$ impacts.

The Sinstair (Simulated Stair) tester is employed to measure wear and imparts an impact to a bent carpet fabric. A description of the Simstair tester is given in U.S. Pat. No. 3,323,349. In general, the wear produced by the tester is quite similar to observed stair wear, there being noticed at first on a test sample an initial flattening of the fiber followed by a breaking thereof, and finally actual attrition of the fibers. The end point for the Simstair tester is determined as a number of cycles at which point 80 percent of the total fibers are broken along the line of heaviest wear.

1. A process for wet spinning abrasion-resistant acrylonitrile-containing filaments having essentially void-free structures, comprising forming a spinning dope by dissolving (A) from about 20 to about 28 weight percent of a dry polymeric material containing about 35 to about 98 weight percent acrylonitrile and 65 to 2 weight percent of at least one other mono-olefinic monomer copolymerized with said acrylonitrile in (B) a mixture of about 1 to 8 weight percent water and about 62 to about 79 weight percent of a solvent selected from the group consisting of dimethylacetamide, dimethylformamide and dimethylsulfoxide, the weights being based on the weight of the dope, and extruding the dope at a temperature within the range of 40° C to 75° C into an aqueous solution of about 40 to 64 weight percent of said solvent at a coagulation temperature of from about 30° C to about 65° C.

2. A process as recited in claim 1 wherein the water in the spinning dope is from about 3 to 6 percent by weight of the dope.

3. A process as recited in claim 1 wherein the coagulation temperature is between about 50° C to 60° C.

4. A process for wet spinning an abrasion-resistant acrylonitrile-containing filament having essentially a void-free structure comprising forming a spinning dope by dissolving (A) from about 23 to 27 weight percent of a dry polymeric material containing about 35 to about 90 weight percent of at least one other mono-olefinic monomer copolymerized with said acrylonitrile in (B) a mixture of from about 62 to 79 weight percent of a solvent selected from the group consisting of dimethylformamide, dimethylacetamide and dimethylsulfoxide, and from about 1 to 8 weight percent water, the weights being based on the dope, and extruding the dope at a temperature within the range of 40° C to 60° C into an aqueous solution of between about 40 to 65 weight percent of said solvent at a coagulation temperature of between 50° C and 60° C.

* * * * *

TABLE I

| Sample | Polymer Composition | Solvent | % $H_2O$ in Solvent | Spin Bath | Spin Bath Temp. | Filament Denier | Elongation | Tenacity | Voids |
|---|---|---|---|---|---|---|---|---|---|
| IA | AN/$VCl_2$/VBr/S/IA 19/1.5/1.5 | DMAc | 0 | DMAc / $H_2O$ | 40° C | 10.54 | 19.6% | 2.37 g/d | Yes |
| IB | " | " | 4 | " | " | 11.06 | 19.0% | 2.67 g/d | No |
| IIA | " | " | 0 | DMAc / $H_2O$ | 30° C | 10.30 | 15.0% | 2.50 g/d | Yes |
| IIB | " | " | 4 | " | " | 10.32 | 14.3% | 2.34 g/d | No |
| IIIA | An/$VCl_2$ 60/40 | " | 0 | " | 38° C | 10.6 | 15.0% | 2.13 g/d | Yes |
| IIIB | " | " | 4 | " | " | 10.15 | 14.9% | 2.52 g/d | No |
| IVA | " | DMSO | 0 | DMSO / $H_2O$ | " | 11.32 | 15.6% | 2.76 g/d | Yes |
| IVB | " | " | 4 | " | " | 10.75 | 16.5% | 2.94 g/d | No |
| VA | AN/VA | DMAc | 0 | DMAc / $H_2O$ | 65° C | 13.2 | 47% | 2.5 g/d | Yes |
| VB | " | " | 2.5 | " | " | 13.3 | 48% | 2.7 g/d | No |
| VIA | AN/VAVBr 87.9/7.1/5 | " | 0 | " | 60° C | 13.8 | 68% | 2.5 g/d | Yes |
| VIB | " | " | 2.6 | " | " | 15.6 | 58% | 2.3 g/d | No |

What is claimed is:

UNITED STATES PATENT OFFICE

CERTIFICATE OF CORRECTION

PATENT NO. : 3,932,577

DATED : January 13, 1976

INVENTOR(S) : George Palethorpe and Edwin W. Folk

It is certified that error appears in the above-identified patent and that said Letters Patent are hereby corrected as shown below:

Table 1, line 1A under "Polymer Composition" column reads:

$AN/VCl_2/VBr/S/IA$
19/1.5/1.5 should read:

$AN/VCl_2/VBr/S/IA$
70/19/1.5/1.5

Signed and Sealed this

Ninth Day of November 1976

[SEAL]

*Attest:*

RUTH C. MASON
*Attesting Officer*

C. MARSHALL DANN
*Commissioner of Patents and Trademarks*